United States Patent [19]

Ribnitz et al.

[11] 4,302,481

[45] Nov. 24, 1981

[54] SPRAY METHOD AND SPRAY DEVICE, PARTICULARLY FOR THE SPRAY-COATING OF ARTICLES WITH POWDER

[75] Inventors: Peter Ribnitz; Hans Giesinger; Karl Buschor, all of St. Gall, Switzerland

[73] Assignee: Gema AG, Switzerland

[21] Appl. No.: 95,095

[22] Filed: Nov. 16, 1979

[30] Foreign Application Priority Data

Nov. 14, 1978 [DE] Fed. Rep. of Germany ..... 2849261
Jul. 25, 1979 [DE] Fed. Rep. of Germany ..... 2930121

[51] Int. Cl.[3] ..... B05B 5/02; B05B 15/02; B05D 1/06

[52] U.S. Cl. ..... 427/27; 239/3; 239/8; 239/704; 239/112; 427/201; 427/424

[58] Field of Search ..... 239/1, 3, 8, 690–708, 239/106, 112, 113, 304, 305, 307; 251/61.1; 118/302, 310; 406/128, 192; 427/27, 30, 201, 424

[56] References Cited

U.S. PATENT DOCUMENTS 3,746,254 7/1973 Duncan et al. ..... 239/697
4,125,125 11/1978 Ezekoye et al. ..... 251/61.1 X

FOREIGN PATENT DOCUMENTS 1245847 7/1967 Fed. Rep. of Germany .
1481189 2/1969 Fed. Rep. of Germany .
2237507 2/1973 Fed. Rep. of Germany .
2302792 10/1976 France ..... 239/112

*Primary Examiner*—Andres Kashnikow
*Attorney, Agent, or Firm*—Ostrolenk, Faber, Gerb & Soffen

[57] ABSTRACT

A method and apparatus are disclosed for spray coating one or a series of objects with at least two powder coating materials in succession or alternately. When a change of the material being sprayed is to be effected, the flow of the first material is terminated, preferably by means of a squeeze valve, the flow path of the first material is flushed with a fluid, preferably air, and the second spray material is sprayed. The relative positions of the apparatus forming the respective flow paths of the two spray materials are not changed during this process. In one preferred embodiment, feed conduits corresponding to respective spray materials converge into a single delivery conduit. Each feed conduit includes means for closing and opening it. Means are provided for flushing at least part of a given feed conduit, or the delivery conduit, or both, with a fluid. The flushing can preferably be done pulsatingly.

43 Claims, 2 Drawing Figures

SPRAY METHOD AND SPRAY DEVICE, PARTICULARLY FOR THE SPRAY-COATING OF ARTICLES WITH POWDER

BACKGROUND OF THE INVENTION

The present invention relates to a spray method and a spray device, particularly for the spray-coating of articles with powder, in which at least two different spray materials are fed via separate feed lines only one selected spray material being discharged to a spray apparatus at one time via a discharge conduit which is common to all of the feed conduits.

In a known device of this type (German Unexamined Application for Patent No. 22 37 507), the feed conduits must be rotated with respect to the common delivery conduit to connect a selected conduit. The known device serves for the spray-coating of articles with powder. In this case, there occur problems as to sealing and difficulties in the avoiding of undesired deposits of powder in the transition region between the feed conduits and the delivery conduit. These difficulties increase when the sealing surfaces become worn after a certain period of operation.

The powder is conveyed by propellant gas and passes downstream of the said known device, for example, to a powder spray gun such as known from German Pat. No. 20 30 388. From that German patent it is also known to electrostatically charge the sprayed powder so that it is attracted by the article to be coated and adheres better to it.

Pipe switches such as known from German Unexamined Application for Patent No. 1 481 189 and from German Provisional Patent No. 1 245 847 have not been used up to now for spraying, particularly for the spray-coating of articles with powder. This may be due to the entirely different technical fields. Other important reasons may be that the known pipe switches are traversed in the direction opposite to that of the invention and that there is a danger that the spray material would deposit in them. Such deposits might pass during the spray-coating as clots of color onto the article to be coated. Again, it might not be possible to remove the clots during ordinary cleaning procedures, in which case they would then mix with a subsequently employed coating material, which would lead to defects in coating or to the spraying device becoming clogged after some time. Spray-coating, particularly with powder, is a very sensitive procedure, since the mixing or even very small particles of a different material with the material which is being applied at the time leads to such extensive defects in coating that the coating is unusable.

These sealing problems and a moving of the conduit or parts of the conduit as well as a mixing of different spray materials upon change from one spray material to another are to be avoided by the present invention. Furthermore the invention solves the problem of simplifying the spraying process and the apparatus necessary for it and of making it more economical and diversified in use.

SUMMARY OF THE INVENTION

It is the principal object of the invention to provide a simple and efficient apparatus and method for spray-coating objects and for switching from one spray material to another easily and conveniently.

It is another object of the invention to provide such an apparatus and method including means for cleaning the portion of the apparatus through which several spray materials pass in succession after each use.

It is a further object of the invention to provide an apparatus for achieving the foregoing objects having no sealing surfaces and no points at which a spray material is likely to accumulate.

These objects are achieved in accordance with the method of the invention by ensuring that at each moment, only the desired feed conduit is open and the other feed conduit or conduits are closed, the entering end sections of the feed conduits being stationary with respect to the delivery conduit, and that conduit. The region located between the points at which the feed conduits are closed off and the upstream part of the delivery conduit is flushed with an additional fluid so that said region can be cleaned, when the flow of spray material is interrupted to change from one spray material to another. In accordance with the apparatus of the invention, this goal is achieved by making all feed conduits discharge into the delivery conduit and providing the feed conduits with conduit closure devices. At least one additional conduit for the introduction of an additional fluid discharges into the region between the conduit closure devices and the upstream part of the delivery conduit.

In this way one avoids the use of sealing surfaces, which are subject to particular wear. Furthermore there are no points of unfavorable flow properties at which spray material could accumulate. Upon a change from one spray material to another, the conduit sections concerned can easily be cleaned of any traces of the spray material which was first used by the introduction of a suitable fluid downstream of the feed conduit closure devices, these conduits being thus flushed. Furthermore the invention has advantage that by the opening of several feed conduits different spray materials can be mixed together and then sprayed in mixed form without additional equipment.

As the cleansing fluid, a gas and in particular air is preferred. The invention is of particular utility for the spray-coating of articles with a powdered to granular spray material, referred to hereinbelow as "powder".

One particular feature of the invention resides in the fact that the additional fluid is so introduced, preferably radially or tangentially, into that upstream section of the delivery conduit into which the spray materials are fed that the additional fluid is eddied. In this way the cleaning action of the fluid is increased. Furthermore, if desired, the additional fluid can be used not only for cleaning but also for intensive mixing with the spray material. Particularly with powdered spray material it is advisable to use gas and preferably air as the additional fluid.

Upon change from one spray material to another, mixing of the two materials and the consequent coating defects are in particular avoided, without any special expenditure of time for cleaning being required, if the additional gas is first fed at low pressure to the said region of the conduit during the conveyance of coating powder for the normal spray operation and, upon change of powder, for the flushing and cleaning of the conduits, supplied at high pressure, preferably pulsating rapidly.

One particular feature of a preferred embodiment of the apparatus of the invention resides in the fact that the downstream sections of the feed conduits discharge converging towards each other into the upstream section of the delivery conduit, and the feed conduits converge in a funnel shape, the convergence of the funnel walls corresponding essentially to the convergence of the feed conduits at least at the upstream region. In this way a particularly frictionless transition of flow from the feed conduits into the delivery conduit is assured.

Another special feature of the invention resides in the fact that injector conveyance devices operating in accordance with the Venturi or diffuser principle are connected to the upstream ends of the feed conduits. The vacuum regions of these conveyor devices are connected in each case to two sources of gas, one of which delivers gas of low pressure during the powder coating while the other delivers gas of high pressure after the conveying of powder by the corresponding conduit has been terminated. In this way the conduits for the spray material in question are cleaned by the high-pressure gas, without any additional apparatus being required for this purpose.

This prevents powder from adhering to the interior of the feed conduit in question after spraying. Such accumulated powder would be expelled as a surge of powder when that color of powder is again used.

By "pressure gas sources" or "pressure air sources" are meant in each case individual supply conduits which can be fed from separate pressure-gas production units or a common one.

The number of moving mechanical parts is minimized by the invention. Switching to different conditions of the apparatus and methods is effected in a simple manner by valves which can be connected, possibly with the interposition of pressure reducers, to the same pressure-air production system. As valves for the spray-material conduits the known "squeeze valves" are particularly suitable.

According to the method of the invention, in cases like spray-coating of one substance, in which absolutely no traces of a spray material previously used are to be present, it is advisable in accordance with the invention upon change of the spray material to start the spraying of the new spray material a short time before an article to be sprayed is moved into the spray region, preferably 0.5 to 3 seconds before.

The present invention permits this to be done simply and conveniently and without special equipment.

BRIEF DESCRIPTION OF THE FIGURES

Two embodiments of the invention will be described below with reference to the drawings, in which.

DETAILED DESCRIPTION OF THE INVENTION

Figure 1:
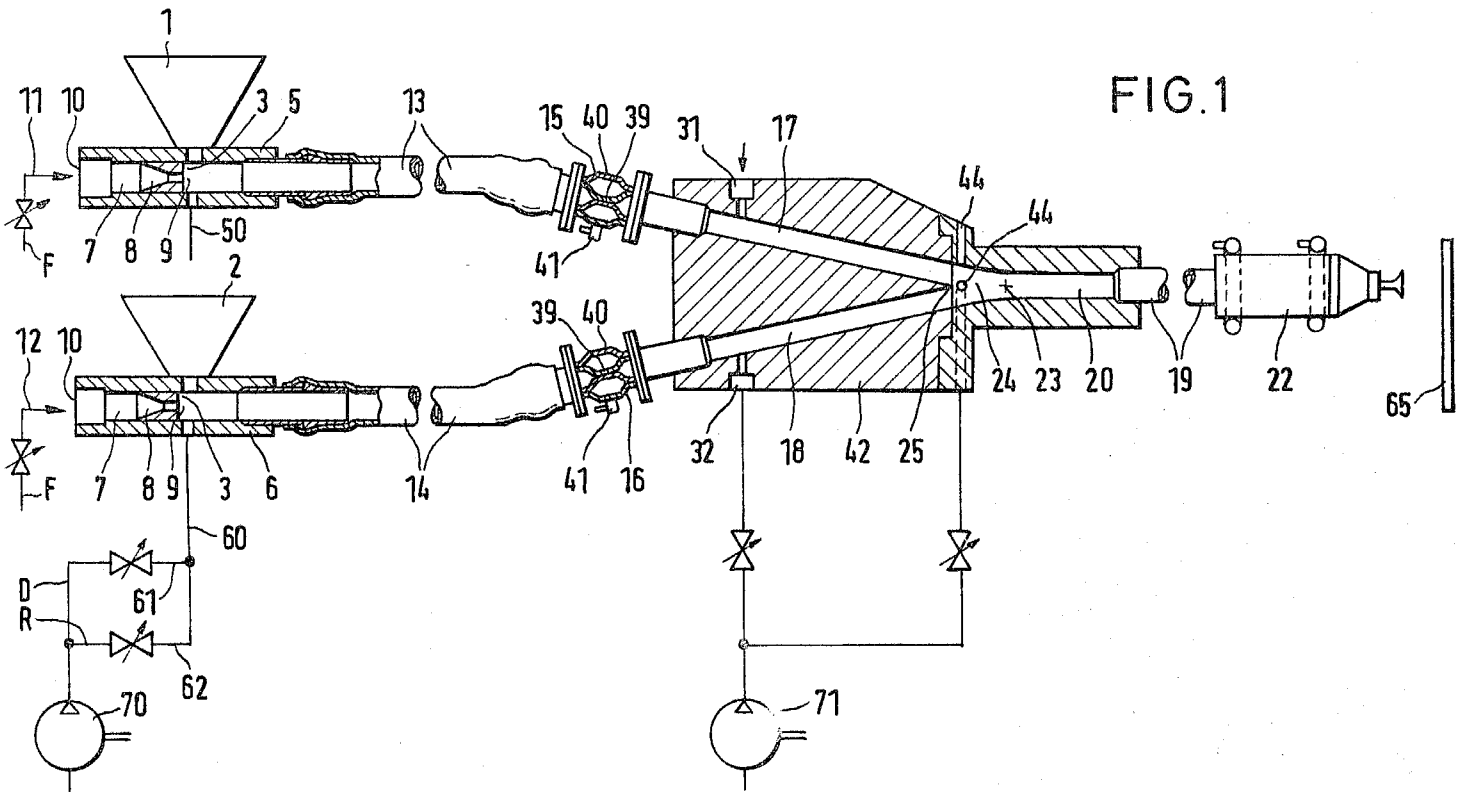
FIG. 1 is a diagrammatic longitudinal section through a device in accordance with the invention.

FIG. 1 shows two powder containers 1 and 2. A larger number, such as six, may be provided. The lower end of the powder containers 1 and 2 is connected in each case to the vacuum region 3 of an injector conveyor device 5 and 6, respectively. The vacuum region 3 is produced by a conveyor channel 7 provided with a channel constriction 8 and a downstream channel widening 9 in accordance with the Venturi or diffuser principle. A propellant gas 11 or 12 from a conveyor gas conduit F is fed to the inlet 10 of the conveyor channels 7 and draws powder out of the containers 1 and 2, respectively, into the vacuum regions 3. The propellant-gas/powder mixture passes via a feed conduit 13 and 14, a squeeze valve 15 and 16 respectively and a feed channel 17 and 18 respectively into a delivery channel 20. From there it passes without further interruption via a conduit 19 to an atomization device 22 in the form of a powder spray gun. The latter may be provided in known manner with means for the electrostatic charging of the powder. The channels 17, 18 and 20 are part of a distributor 42.

The feed channels 17 and 18 as well as the feed channels of other colored powders (not shown in the drawing) are arranged conically with respect to each other in such a manner that they all discharge into the upstream end of the delivery channel 20 and such that their center lines meet at a point 23 in delivery channel 20. The upstream section of the delivery channel 20 forms a sort of mixing chamber 24. In chamber 24 the downstream ends of the feed channels 17 and 18 are separated from each other only by a sharp-edged or acute web 25.

A gas connection 31 and 32 for introducing gas for the flushing and cleaning of the powder channels discharges into each feed conduit or feed channel 17 or 18 just downstream of the squeeze valve 15 or 16 respectively. Each of the squeeze valves 15 and 16 contains an elastic channel wall 39 which can be squeezed by a fluid, preferably gas, which can be introduced into a surrounding housing 40 via connection 41.

To one side of the vacuum region 3 of each injector conveyor device 5 and 6 there is connected a pressure gas conduit 50 and 60 respectively. Since the function of the two conduits 50 and 60 is the same, only the conduit 60 will be described below. The drawing shows that the conduit 60 can be supplied with pressure gas by two separate conduits 61 and 62. The compressed air fed via the conduit 61 serves to set the pressure in the vacuum region 3 and thus to set the conveyor output. Via the conduit 62 compressed air of higher pressure can be fed in order to clean the feed conduit 14 of powder when the spraying with powder from the container 2 is to be terminated, for example when powder is to be sprayed from container 1.

In the drawing, the air fed via the conduit 62 is designated R, the air fed via the conduit 61 is designated D, and the conveyor air fed to the inlet 10 is designated by 12. All three types of pressure air can be taken from one source of pressure gas 70, e.g. via pressure reduction valves.

A pressure gas source 71 serves for the supplying of the supplementary gas connections 31, 32 and 44.

The operation of the apparatus is now described.

When changing for instance from the colored powder of container 2 to the colored powder of container 1, the air feeds 12 and D, which in the operating condition operate and control the conveyor injector 6, are shut off. The cleaning air R is connected, with the result that the feed conduit 14, the feed channel 18, the delivery conduit 20, the conduit 19 and the gun 22 are cleaned. During this phase, the high voltage source of the gun 22 remains connected so that the powder emitted from the gun 22 during cleaning is deposited to the article 65 to be coated. The cleaning air R is then disconnected and the squeeze valve 16 is closed. Next, the gas connections 32 and 31 and the gas channels 44 are supplied with an increased amount of air to clean the feed conduit channel 18 and the delivery conduit 20, particularly the upstream chamber 24 thereof, the gas channels 44 discharging radially into the chamber 24. As few as one such radial gas channel 44 may be provided. At the same time the feed channel 17 is kept clean by the air admitted via gas connection 31.

The radial introduction of the cleaning air for the gas channels 44 permits a high velocity along the walls of the chamber 24 and thus a strong cleaning effect. The gas channels 44 may, alternatively, discharge tangentially into the chamber 24.

The cleaning air which acts via the connections 32 and 44 is fed in pulses rather than continuously, that is to say it is connected and disconnected in rapid alternation.

The flow of air fed via the gas connections 32 and 44 is then reduced to a minimal value and is no longer fed in pulsating fashion but continuously. This results in continuous cleaning of the feed conduit channels 17 and 18 and of the upstream chamber-like section 24 of the delivery conduit 20 during the conveying of powder.

At the same time the squeeze valve 15 of the feed conduit 13 is opened and the injector 5 of the powder container 1 is placed in operation. This takes place preferably 0.5 to 3 seconds before entrance of the next article 65 into the region of the gun 22, so that the first few grams of the new-colored powder from container 1 can carry out a cleaning action.

In one modification of the invention, the valves 15 and 16 are arranged in the feed conduits 13, 17 and 14, 18 directly upstream of the section 24 of the delivery conduit 20. In this case, the gas connections 31 and 32 which serve for the cleaning can be dispensed with since the gas of the gas channels 44 then cleans the conduits up to these valves.

Figure 2:
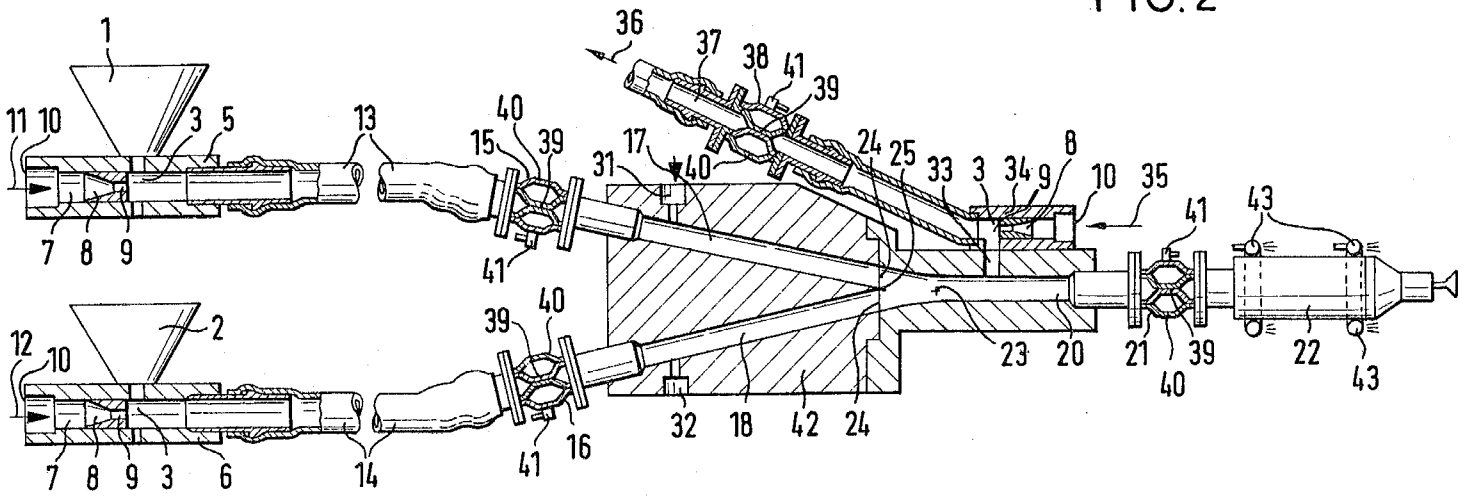
FIG. 2 is a similar longitudinal section through another embodiment of the invention.

In the embodiment of FIG. 2 there are also shown two powder containers 1 and 2. Other powder containers may be provided, if desired, all of which can contain different powders, for instance powders of different colors. The lower end of the powder containers 1 and 2 discharges in each case into the vacuum region 3 of an injector conveyor device 5 and 6 respectively. The vacuum region 3 is produced by a conveyor channel 7 provided with a channel constriction 8 and a downstream channel broadening 9 in accordance with the Venturi or diffuser principle. A propellant gas 11 or 12 respectively fed in each case of the inlet 10 of the conveyor channel 7 draws powders out from the container 1 or 2 respectively into the vacuum region 3. Air is generally used as the propellant gas. The propellant-gas/powder mixture passes via a feed conduit 13 or 14 respectively a squeeze valve 15 or 16 respectively and an adjoining feed channel 17 or 18 respectively into a delivery channel 20. From there it passes via another squeeze valve 39 to a powder spray gun 22 of known construction. The latter, also in known manner can have a device for the electrostatic charging of the powder which is to be sprayed.

The feed channels 17 and 18 as well as the feed channels of other colored powders not shown in the drawing, are arranged conically in such a manner that they meet at a given point 23 at the upstream end of the delivery channel 20 and discharge into a mixing chamber 24 in the delivery channel. In this way only a sharp-edged or acute web 25 remains between the channel mouths 24.

Within each feed channel 17 and 18, near its upstream end there discharges a gas connection 31 or 32 respectively, the purpose of which will be described further below. The gas which is fed to this gas connection 31 or 32 is preferably air.

The delivery channel 20 is connected via a connecting channel 33 which discharges transversely into it with the vacuum region 3 of an injector conveyor device 34 which operates in accordance with the same principle as the injector conveyor devices 5 and 6. Its inlet 10 can be fed propellant gas 35 which, as a result of the vacuum region 3, can remove via the connecting channel 33 any gas and powder present in the delivery channel 20. The gas-powder mixture withdrawn in this manner is discharged via a discharge conduit 37 containing a squeeze valve 38 and can if desired be treated for reuse. Air is normally used as propellant gas 35.

Each of the squeeze valves 15, 16, 21 and 38 contains elastic channel walls 39, which can be squeezed together by a fluid, preferably gas, in the surrounding housing 40 so that the channel is completely closed. Connections 41 serve for feeding pressure gas into the space between the elastic channel wall 39 and the housing 40.

The individual sources of gas or compressed air for the inlets 10, 31 and 32 and the corresponding pneumatic conduits as well as the necessary pneumatic distribution batteries and required solenoid valves are not shown in detail in the drawings since they can all be developed without difficulty by one skilled in the art.

The operation of the second embodiment is now described.

In the embodiment described, two colors are provided in the form of different powders which are contained in the containers 1 and 2 respectively which may be conical at the bottom. A powder gas mixture is formed in the injector conveyor device 5 and 6 respectively so that transport is possible in the feed conduits 13 and 14 respectively.

The squeeze valves 15 and 16 as well as the other valves operate as follows. A chamber of pressure-resistant plastic surrounds a cylindrical hose. When this chamber is filled with compressed air, the hose, which forms the elastic channel wall 39, is squeezed shut, and the flow of powder through it is interrupted. The squeeze valves 15 and 16 of the feed conduits 13 and 14 respectively are all connected to a distributor head 42 in which the feed channels 17 and 18, the gas connections 31 and 32, the delivery channel 20 and the connecting channel 33 are located. This distributor head 42 is developed in such a manner that all feed channels 17 and 18 converge at a single point 23 so that no great changes in cross section occur.

The process of changing a color or a powder is now described.

At first the color or powder of, for example, container 1 is to be sprayed and the injector conveyor device 5 is supplied with compressed air 11. The compressed air draws the color powder out of the powder container 1 and produces a powder-air mixture which is transported in the feed conduit 13 to the squeeze valve 15. In this case the squeeze valve 15 is not closed, as shown in the drawing, but open. From here the feed channel 17 conducts the mixture through the distributor head 42 and past the injector conveyor device 34 through the opened squeeze valve 21 to the powder spray gun 22. Although the squeeze valve 21 is shown closed in the drawing, it is open for the process described above. On the other hand the squeeze valve 16 is closed, as shown, during this process and, via the gas connection 32, a small amount of flushing air is fed to the feed channel 18, for preventing individual particles of powder from traveling back channel 18 towards the squeeze valve 16. In the same way the squeeze valve 38 is closed so that powder cannot pass into the delivery conduit 37 via the injector conveyor device 34.

If now a change is to be made from one color to a different color i.e. from the powder of the one container 1 to the powder of the other container 2, then first of all the feed to the injector conveyor device 5 of the air 11 serving as propellant gas is interrupted. Then the squeeze valve 15 is closed, the squeeze valve 38 is opened, and compressed air is fed as propellant gas (for instance at about 5 to 8 bar) to the inlet 10 of the injector conveyor device 34. In this way the spray gun 22 is cleaned of still adhering residual powder from container 1. The residual powder is fed via the discharge conduit 37 to a mixed-powder container (not shown). The first cleaning phase lasts about 5–6 seconds. After this, the squeeze valve 21 upstream of the spray gun 22 is closed. The injector conveyor device 34 serving for the discharge continues in operation and now cleans the distributor head 42, including the feed channels 17 and 18 which are flanged onto it. If necessary, the process which has just been described can be repeated again. As has been shown by practical tests, a normal change of color or powder is possible within 6 to 10 seconds.

The squeeze valve 16 is now opened and the injector conveyor device 6 is fed compressed air serving as propellant gas 12. The latter now produces a powder-air mixture of the powder-color contained in container 2. This mixture is fed through the conduit 14 to the squeeze valve 16. Gas is applied to connections 31 and 32 to flush or clean channels 17 and 18, etc.

The injector conveyor device 34 which serves for the discharge is still in operation at this point to draw off the first powder particles from the container 2 that enter delivery channel 20. After a short time, the inlet 10 of the injector conveyor device 34 is disconnected from the compressed air feed and the squeeze valve 38 is closed.

Before the injector conveyor device 6 at the inlet 10 is fed with compressed air, the squeeze valve 21 for the feeding of powder to the spray gun 22 must be opened.

Blast nozzles 43 arranged on the outer circumference of the spray gun 22 is both embodiments prevent individual particles of powder from being deposited on its surface.

Practical tests have shown that a normal change of color or powder can be carried out within 6 to 10 seconds.

We claim:

1. A method for spray-coating objects with a powdered coating material selected from a plurality of powdered coating materials, comprising the steps of:

transporting a first powdered coating material via a first feed conduit and a delivery conduit to a spray gun, for spraying an object therewith;

terminating the flow of the powdered coating material;

transporting a second powdered coating material via a second feed conduit and the delivery conduit to the spray gun, for spraying the object therewith; these three steps being performed without changing the relative position of the conduits; and flushing with a fluid at least a portion of the respective path along which each powdered coating material is transported to the spray gun, the flushing step being performed at least during a time when no powdered coating material is being transported through the portion of the path that is flushed.

2. The method of claim 1, wherein the fluid is introduced into at least a portion of a given transport path after termination of transport of powdered coating material therealong.

3. The method of claim 1, wherein the fluid is introduced with a component of motion transverse to the direction of extension of the transport path into which it is introduced, to eddy the fluid.

4. The method of claim 3, wherein the fluid is also introduced into a transport path at a relatively low pressure during transportion of a powdered coating material.

5. The method of either of claims 3 or 4, wherein the fluid is introduced in pulses at a relatively high pressure between powdered coating material transportation steps.

6. The method of claim 1, wherein the entire transport path of each powdered coating material is flushed with the fluid after the flow of the corresponding powdered coating material therethrough is terminated.

7. The method of claim 6, wherein the fluid is introduced into a given transport path at the beginning thereof.

8. The method of claim 6, comprising the further step of closing off a given transport path after it has been flushed, and then introducing additional flushing fluid thereinto.

9. The method of claim 8, wherein each closure of a transport path is effected by means of a squeeze valve disposed therein.

10. The method of claim 8, comprising the further step of electrostatically charging and atomizing any residual powdered coating material expelled from its transport path by the fluid and spraying the atomized residual powdered coating material on the object to be sprayed with that powdered coating material.

11. The method of claim 1, wherein spraying of the second powdered coating material is begun from 0.5 to 3 seconds before an object to be sprayed therewith is in the proper position for spraying.

12. The method of claim 1, wherein each powdered coating material is transported by means of a propellant gas.

13. The method of claim 1, wherein the fluid is also introduced into the transport paths during the transporting steps.

14. The method of claim 1, further comprising the step of cleansing the transport path of the first powdered coating material before performing the step of transporting the second powdered coating material.

15. The method of claim 14, wherein the cleansing step comprises the further steps of producing a vacuum in accordance with the Venturi principle, and applying the vacuum to exert suction in a direction that is transverse to the transport path of the first powdered coating material at the point at which the suction is exerted.

16. The method of claim 15, wherein the delivery conduit is closed during the suction, at a point downstream of the exertion of the suction.

17. The method of claim 16, wherein the suction continues to be exerted after transportation of the second powdered coating material is begun.

18. The method of claim 16, wherein the suction continues to be exerted after transportation of the second powdered coating material is begun.

19. The method of claim 1, wherein the spray materials are powders and the fluid is a gas.

20. The method of claim 19, wherein the gas is air.

21. Feeding apparatus for use in a spray device, comprising:

delivery conduit means for delivering a powdered coating material for spraying;

a plurality of feed conduit means for feedng respective powdered coating materials to the delivery conduit means, each feed conduit means feeding the delivery conduit means;

respective conduit closure means for controlling flow in each feed conduit means, whereby a powdered coating material can be supplied to the delivery conduit means via selected feed conduit means; and additional conduit means for introducing a fluid into a region including the portion of each feed conduit means downstream from the conduit closure means, for flushing the region.

22. The apparatus of claim 21, wherein the additional conduit means communicates with the delivery conduit means for introducing the fluid into the delivery conduit means.

23. The apparatus of claim 23, wherein the additional conduit means is adapted for introducing the fluid radially, for eddying the fluid in the delivery conduit means.

24. The apparatus of claim 22, wherein the additional conduit means is adapted for introducing the fluid tangentially, for eddying the fluid in the delivery conduit means.

25. The apparatus of claim 21, wherein the additional conduit means communicates with each of the feed conduit means at a point downstream of and relatively near the respective conduit closure means.

26. The apparatus of any one of claims 23, 24 or 25, wherein the delivery conduit means has a region having a larger cross-section than the remainder of the delivery conduit means and a larger cross-section than any of the feed conduit means, and wherein the additional conduit means includes at least one conduit communicating with the large cross-sectional region for introducing the fluid thereinto.

27. The apparatus of claim 26, wherein the feed conduit means have respective downstream ends that converge toward each other and discharge into the delivery conduit means, the delivery conduit means having an upstream end forming a funnel-shaped space that is the large cross-sectional region and that includes the converging downstream ends of the feed conduit means.

28. The apparatus of claim 25, further including means for introducing the fluid into selected ones of the feed conduit means, whereby each feed conduit means can be selectively flushed after use.

29. The apparatus of any one of claims 23, 24 or 25, further comprising a source of a pressurized gas, for supplying the gas to the additional conduit means, the gas being the fluid.

30. The apparatus of claim 29, further including means cooperating with the additional conduit means to supply the gas selectively at a first, relatively low, pressure or in pulses at a second, relatively high pressure.

31. The apparatus of claim 29, wherein the source of pressurized gas is a source of pressurized air.

32. The apparatus of claim 21, wherein each feed conduit means has an upstream end, and further comprising a respective injector conveyor device for feeding a respective spray material to the upstream end of each of the feed conduit means when the conduit closure means thereof is open.

33. The apparatus of claim 32, wherein the injector conveyor devices each comprise a respective vacuum region for operation according to the Venturi principle.

34. The apparatus of claim 33, wherein each injector conveyor device further comprises means for supplying to its vacuum region a gas, at a relatively low pressure when spray coating is to be performed with the powdered coating material corresponding to that injector conveyor device and at a relatively high pressure after completion of such spray coating.

35. The apparatus of claim 21, further comprising a suction device communicating with the delivery conduit means for drawing a powdered coating material therefrom.

36. The apparatus of claim 35, wherein the suction device includes a conveyor channel having a constricted portion and a widened portion to produce a vacuum region for operation according to the Venturi principle.

37. The apparatus of claim 35, wherein the delivery conduit means is provided with a conduit closure means for terminating spraying.

38. The apparatus of either of claims 21 or 27, wherein each conduit closure means further comprises a squeeze valve having a closable flow channel in the delivery conduit means and defined by a flexible wall in the delivery conduit means; a pressure chamber surrounding the flexible wall, for controlling the degree to which the flow channel is open.

39. The apparatus of either of claims 21 or 25, further comprising spray gun means for receving a mixture of a powdered coating material and a propellant gas from the delivery conduit means and for spraying an object therewith.

40. The apparatus of either of claims 21 or 35, wherein each feed conduit means has a downstream end and wherein the downstream ends of the feed conduit means converge to form acute angles with each other, the downstream ends of the feed conduit means being separated from each other only by a sharp-edged web, for discharging into the delivery conduit means.

41. The apparatus of claim 40, wherein the downstream ends of the feed conduit means converge in a generally conical configuratiion for discharging into the delivery conduit means.

42. The apparatus of claim 21, wherein each feed conduit means has a respective downstream end section, the downstream end sections of the feed conduit means converging to form acute angles with each other and to discharge into the delivery conduit means, and the downstream ends of each two feed conduit means being separated from each other only by a small web.

43. The apparatus of claim 21, wherein the conduit closure means are for controlling the flow in each feed conduit means in such a manner that a powdered coating material can be supplied to the delivery conduit means via selected feed conduit means without changing the relative position of the conduit means.

* * * * *